US006814936B1

(12) United States Patent
Enhorning

(10) Patent No.: US 6,814,936 B1
(45) Date of Patent: Nov. 9, 2004

(54) PIPETTE ASSEMBLY HAVING A SMALL VOLUME DISPOSABLE TIP

(76) Inventor: Goran Enhorning, 21 Oakland Pl., Buffalo, NY (US) 14222

( * ) Notice: Subject to any disclaimer, the term of this patent is extended or adjusted under 35 U.S.C. 154(b) by 355 days.

(21) Appl. No.: 09/609,918

(22) Filed: Jul. 3, 2000

Related U.S. Application Data

(60) Provisional application No. 60/141,981, filed on Jul. 1, 1999.

(51) Int. Cl.[7] ..... B01L 3/02

(52) U.S. Cl. ..... 422/100; 422/104; 73/864.01; 73/864.11; 73/864.13; 73/864.91

(58) Field of Search ..... 422/100, 104; 73/864.01, 864.11, 864.13, 864.91

(56) References Cited

U.S. PATENT DOCUMENTS

| | | | | |
|---|---|---|---|---|
| 2,959,964 A | | 11/1960 | Streitfeld | |
| 3,232,117 A | | 2/1966 | Gilmont | |
| 3,608,146 A | * | 9/1971 | Dunipace | 425/302.1 |
| 4,023,716 A | | 5/1977 | Shapiro | |
| 4,072,330 A | | 2/1978 | Brysch | |
| 4,099,548 A | | 7/1978 | Sturm et al. | |
| 4,165,646 A | | 8/1979 | Shapiro | |
| 4,250,755 A | | 2/1981 | Kenney | |
| 4,261,205 A | | 4/1981 | Oshikubo et al. | |
| 4,284,604 A | | 8/1981 | Tervamaki | |
| 4,362,063 A | | 12/1982 | d'Autry | |
| 4,362,064 A | | 12/1982 | d'Autry | |
| 4,662,545 A | | 5/1987 | Kenney | |
| 4,748,859 A | | 6/1988 | Magnussen et al. | |
| 4,933,148 A | | 6/1990 | Perlman | |
| 4,961,350 A | | 10/1990 | Tennstedt | |
| 4,999,164 A | | 3/1991 | Puchinger et al. | |
| 5,104,624 A | | 4/1992 | Labriola | |
| 5,104,625 A | | 4/1992 | Kenney | |
| 5,171,537 A | * | 12/1992 | Wainwright et al. | 422/100 |
| 5,320,810 A | | 6/1994 | Al-Mahareeq et al. | |
| 5,355,738 A | | 10/1994 | Heinonen | |
| 5,364,595 A | | 11/1994 | Smith | |
| 5,403,553 A | | 4/1995 | Heinonen | |
| 5,406,856 A | | 4/1995 | Kuhn | |
| 5,454,491 A | | 10/1995 | Liu | |
| 5,468,453 A | * | 11/1995 | Holt et al. | 422/100 |
| 5,531,131 A | | 7/1996 | Sabloewski | |
| 5,770,160 A | * | 6/1998 | Smith et al. | 422/100 |
| 5,785,926 A | | 7/1998 | Seubert et al. | |
| 5,844,686 A | | 12/1998 | Treptow et al. | |

FOREIGN PATENT DOCUMENTS

| | | |
|---|---|---|
| EP | 0 014 120 A1 | 8/1980 |
| EP | 0 743 095 A1 | 11/1996 |
| FR | 2319117 | 2/1977 |
| FR | 2446672 | 8/1980 |

OTHER PUBLICATIONS

K.–J. Reinhardt Der Einfluss der Lichtquelle auf die Randständigkeit von Kompositfüllungen Carl Hanser Verlag, München, 1991.

* cited by examiner

*Primary Examiner*—Jill Warden
*Assistant Examiner*—LaToya Cross
(74) *Attorney, Agent, or Firm*—John C. Thompson

(57) ABSTRACT

A pipette assembly (10) having a suction device (12 or 52) and a small volume disposable tip (14) having a capacity with a range of 0.1 μl to 2.0 μl, the disposable tip being removably secured to the suction device. The suction device is provided with a female tip receiver (38.2 or 78.1) which receives a disposable male tip (14). The tip is in the form of a short piece of extruded tubing. The tubing has a very small i.d., for example 0.3 mm. It is preferably formed of Teflon®, or another hydrophobic material.

6 Claims, 4 Drawing Sheets

PIPETTE ASSEMBLY HAVING A SMALL VOLUME DISPOSABLE TIP

This application claims the benefit of Provisional application No. 60/141,981, filed Jul. 1, 1999.

TECHNICAL FIELD

The present invention relates generally to pipettes, and more particularly to a pipette assembly having a suction device and a small volume disposable tip having a capacity with a range of 0.1 μl to 2.0 μl, the disposable tip being removably secured to the suction device.

BACKGROUND OF THE INVENTION

In molecular biology, and in other fields, pipette assemblies having small volume disposable pipette tips are used. These pipette assemblies basically consist of two parts, one part being a pipette body or suction device (similar to a syringe) and the other being the disposable pipette tip. With the suction device an exact amount of vacuum is produced. The disposable pipette tip is tightly attached to the suction device, and the vacuum produced by the suction device sucks a predetermined volume of liquid into the second part. Such tips are shown in EP 0 743 095 A1, as well as numerous other patents. One commercially available pipette assembly is the Gilson Pipetman® P-2 model which is provided with a disposable tip having an advertised range of 0.1–2.0 μl. According to their advertisement, there is minimal air space between the piston in the suction device and the sample which makes the results less technique-dependant. However, with the P-2 model, there is an advertised mean error of ±12% at 0.2 μl. It is believed that the mean error is due in part to the construction of the disposable tip which is a female part that telescopes over a male part of the suction device. The disposable tip is injected molded and, because it has to go outside the male part, it is rather wide and has a large volume, usually more that 30 μl.

OBJECTS AND SUMMARY OF THE INVENTION

It is an object of the present invention to provide a pipette assembly employing a disposable tip which may be used with very small samples in the range of 0.1–2.0 μl with a high degree of accuracy.

It is a further object of the present invention to provide such a pipette assembly wherein the disposable tips are of low cost.

In summary, the pipette assembly of this invention includes a suction device provided with a female tip receiver, which receives a disposable male tip in the form of a short piece of extruded tubing. The tubing has a very small i.d., for example 0.3 mm. It is preferably formed of Teflon®, or another hydrophobic material. This arrangement has three advantages:

1) The volume of air in the tip can be very small (circa 3 μl) which makes it easier to exactly determine the volume of liquid that is sucked into the tip. The larger the air volume the greater is the risk that the vacuum will thin the air whereby the volume of sample liquid will be reduced. This is of particular importance if the liquid has a high viscosity.

2) The disposable tip, i.e., the short piece of extruded tubing, is extremely inexpensive. The volume of plastic used for the tip is very small and although a new tip is used for each sample the volume of plastic consumed is reduced.

3) The material of the tip can be Teflon® or another hydrophobic material. This reduces the risk that any of the sample liquid will remain in the tip after extrusion of the sample.

This invention has application in the apparatus shown in U.S. Pat. No. 4,970,892.

The forgoing objects and other objects and advantages of this invention will be apparent to one skilled in the art after a consideration of the following detailed description taken in conjunction with the accompanying drawings in which preferred forms of the invention are illustrated.

DETAILED DESCRIPTION

Figure 1:
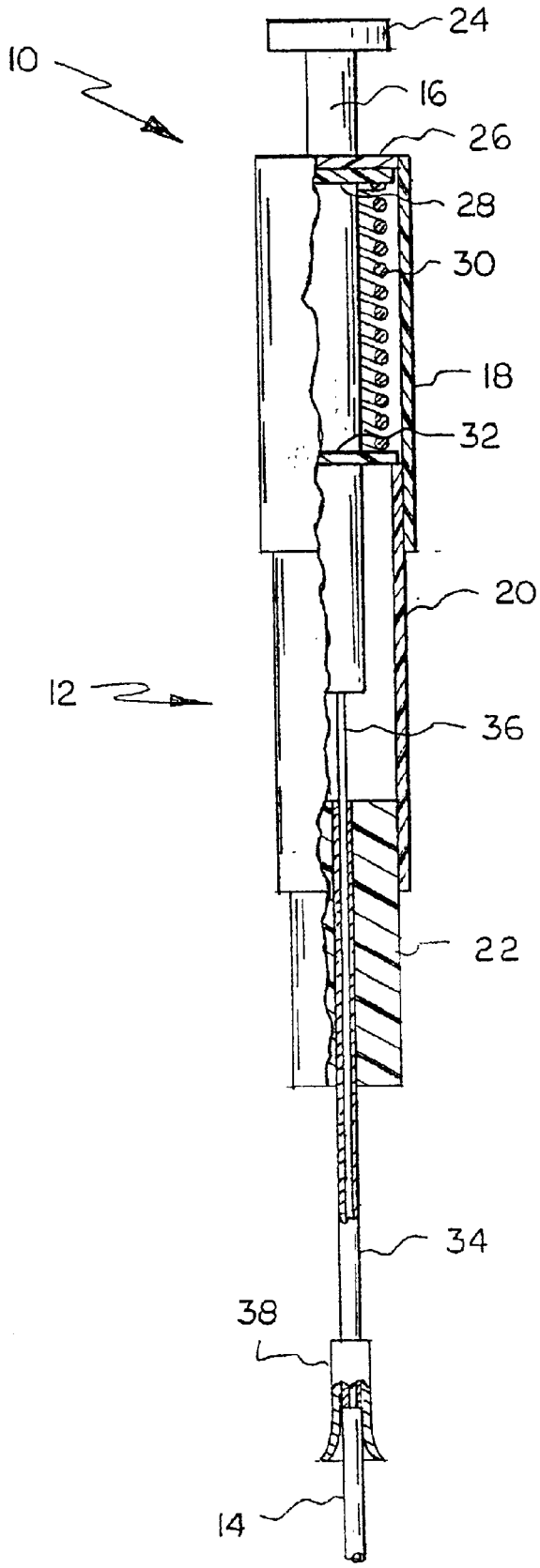
FIG. 1 is a partial cross-section of a first pipette assembly of this invention, this first embodiment including a disposable pipette tip carried by a suction device.
Figure 2:
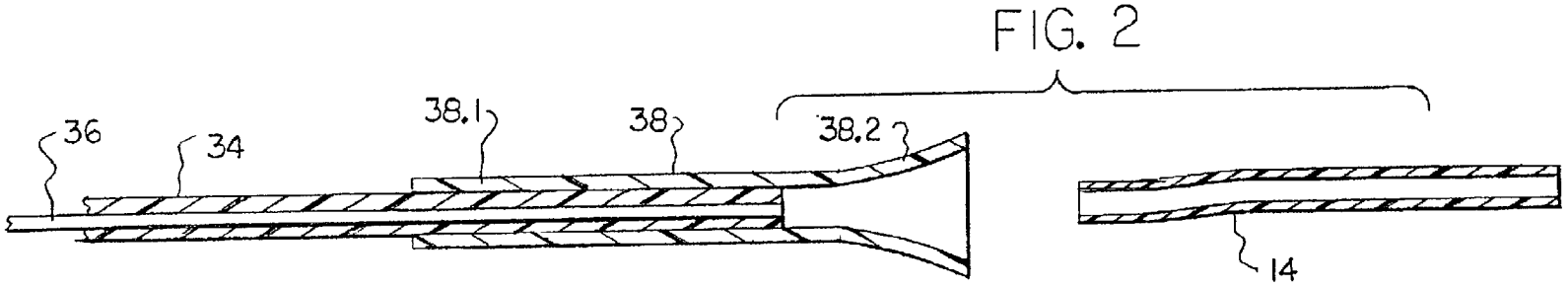
FIG. 2 shows the disposable tip which is in the form of a cut-off male part. The tip, a short piece of an extruded tubing, is shown to the right, ready to be attached by being pushed into the suction device's funnel shaped opening.
Figure 3:
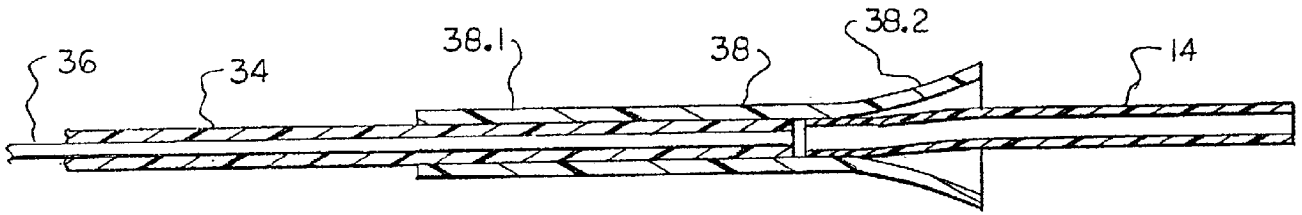
FIG. 3 is a view similar to FIG. 2 showing the relationship of the parts after the disposable tip has been attached.
Figure 4:
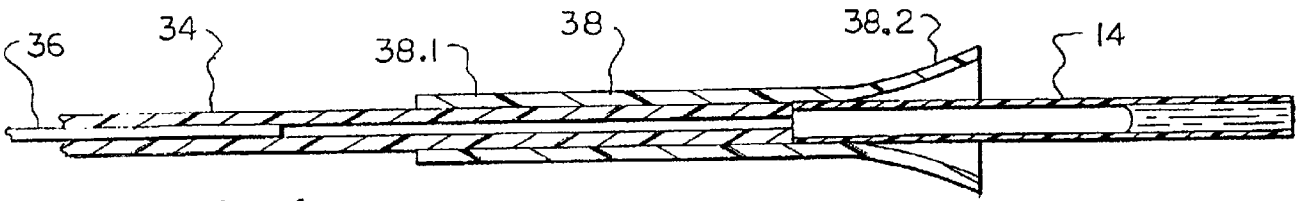
FIG. 4 shows the parts after the piston of the suction device, a thin stainless steel wire, has moved to the left whereby the vacuum produced has sucked a sample into the tip, the sample volume being in the range of 0.1–2 μl.

In the accompanying drawings the pipette assembly of FIG. 1 is indicated generally at 10, and includes two principal components, a pipette body or suction device, indicated generally at 12, and a disposable tip 14. The suction device, as illustrated, includes a plunger 16 mounted within a cylindrical housing formed of three concentric tubular portions 18, 20 and 22, end portions of which are telescoped together. The tubular portions are preferably formed of plastic and are secured to each other in a conventional manner, such as by plastic "welding". The plunger is provided with a button end 24 which can be engaged by the thumb of the pipette operator. The upper end of the topmost tubular member 18 is provided with an apertured disk 26 which slidably receives an end portion of the plunger 16. A second disk 28 is secured to the end portion of the plunger 16 and is engaged at all times by one end of a compression spring 30 which normally biases the disk 28 into engagement with the apertured disk 26. A further apertured disk 32 is carried by the top end of the second tubular portion 20 and the spring 30 bears against this disk at all times, the plunger slidably passing through the aperture in this disk.

A piston cylinder 34 is carried by the tubular portion 22 and is formed with a very small diameter passageway which snugly receives a piston 36 in the form of a wire. The wire is secured to the lower end of the plunger 16 for movement therewith. The wire 36 is formed of a stainless steel, or of other suitable material. The piston cylinder 34 may be formed of stainless steel or other suitable material.

Mounted on the lower end of the piston cylinder 34, which extends beyond the tubular portion 22, is a receiver 38. The receiver 38 has an upper cylindrical portion 38.1 and a lower cone or funnel shaped portion 38.2 which acts as a female tip receiver of the suction device, and which snugly receives the male disposable pipette tip 14.

The male disposable pipette tip 14 consists of a length of tubular material. The tubing is preferably extruded Teflon® tubing, which has a characteristic of being hydrophobic, although other hydrophobic materials may be used. In the illustrated embodiment the extruded Teflon® tubing has an i.d. of 0.3 mm. This material is relatively inexpensive and can be easily cut to the desired length. Also, it is readily available, and has relatively uniform inside and outside diameters. In addition, as the material is deformable to a limited extent, it can be easily inserted into the conical receiving portion or female tip receiver 38.2 of the suction device until it is firmly seated therein.

In operation, a length of extruded teflon tubing 14 will by cut from a supply of tubing and will be forced into the bell shaped tip receiver 38.2 until it is snugly seated therein. To take a sample, it is only necessary press the plunger down until the button 24 contacts the upper end 26, and to dip the end of the tip 14 into the sample. When the plunger is released, the sample will be drawn up into the disposable tip. In the illustrated embodiment, a 1.0 cm stroke of the plunger will produce a 0.5 $\mu$l sample. Because other sample sizes may be desired, the stroke of the plunger may be varied in any conventional manner. Alternatively, as the construction of the suction device is so inexpensive, it may be preferred to provide a plurality of suction devices for differing sample sizes. If this is the case, the suction devices may be color coded, or provided with other indicia so that the operator may know which size sample is to be collected with each suction device. A stand with a C-shaped clip may be provided, which clip is so sized that the barrel portion 20 may be slid into it.

Figure 5:
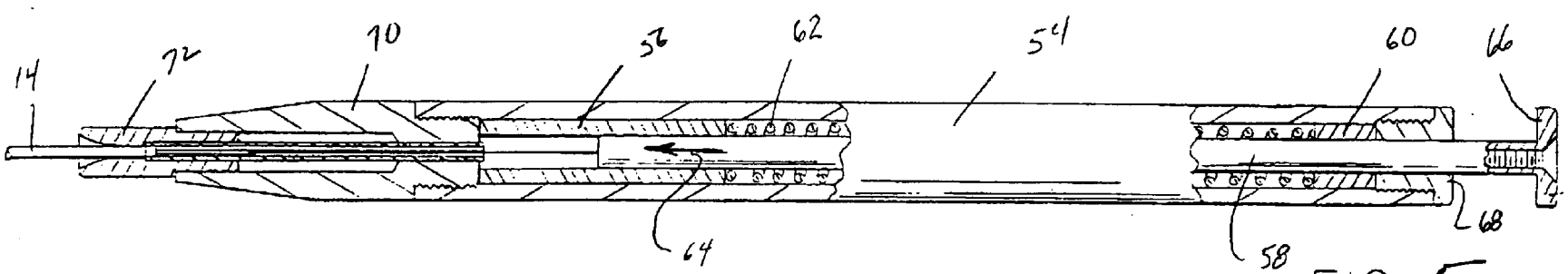
FIG. 5 is a partial cross-section of a second pipette assembly of this invention, this second embodiment also including a disposable pipette tip and a suction device which carries the disposable pipette tip.
Figure 6:
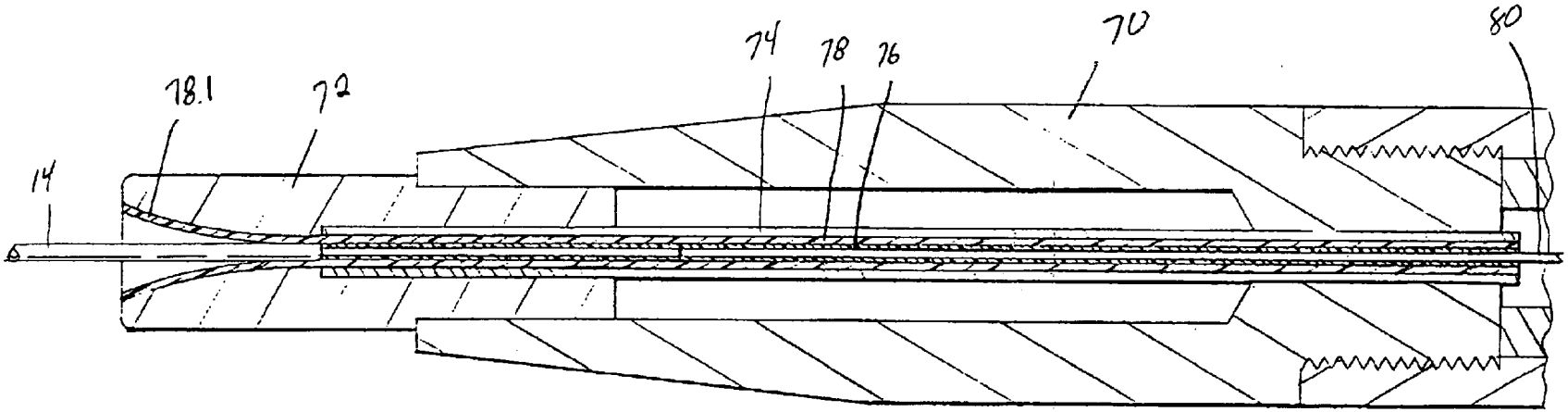
FIG. 6 is an enlarged sectional view of a portion of the assembly shown in FIG. 5.
Figure 7:
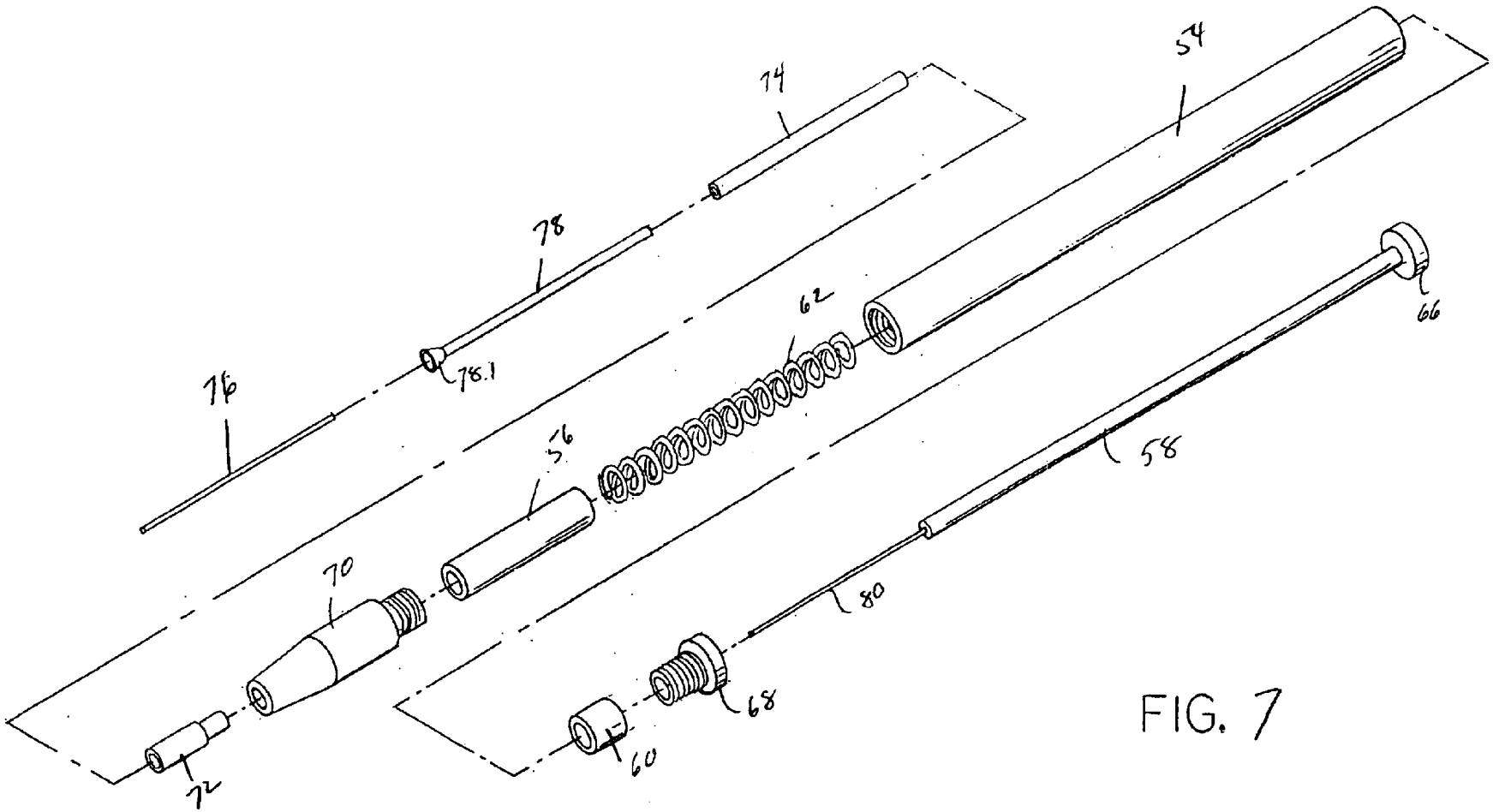
FIG. 7 is an exploded view of the suction device shown in FIG. 5.

The pipette assembly of FIG. 5 also includes a disposable pipette tip 14 and a pipette body or suction device. The disposable pipette tip 14 is of the same construction as that shown in FIGS. 1-4 and described above. The suction device of this embodiment is functionally the same as the suction device 12 of the first embodiment, but is of a somewhat differing construction. Thus, in FIG. 1 a pipette body is illustrated which is formed principally of plastic parts, with the principal exceptions of the spring 30 and the wire 36 which forms the piston. However, in the device shown in FIGS. 5-7 the suction device, which is indicated generally at 52, is formed of a number of stainless steel parts. Thus the principal component is a stainless steel cylindrical barrel 54 which has press fit into one end a cylindrical member 56. The member 56 has a bore which slidably receives a cylindrical plunger 58 which has a cylindrical surface. The plunger carries another cylindrical member 60 which is press fit about the plunger, the cylindrical member 60 having an exterior cylindrical surface which is slidably received within the cylindrical bore of the barrel 54. A spring 62 is disposed between the two cylindrical members 56 and 60, and as can be seen from an inspection of FIG. 5, when the plunger 58 is moved in the direction of arrow 64, the spring will be compressed. To this end the plunger is provided with a button end 66, and the barrel 54 is provided with a threaded end which receives threaded guide 68. While not illustrated, it should be apparent that the threaded guide 68 may be of differing lengths to control maximum movement of the plunger 58. In addition, other methods may be employed for controlling maximum movement of the plunger, for example placing shims between the button end and the guide 68.

The end of the barrel 54 remote from the button end 66 of the plunger 58 is also threaded, and it receives an extension 70. The end of the extension 70 remote from the threaded end receives a further support element 72 which may be force fit into the tip of the extension, or it may be glued in place. As can best be seen from FIG. 6 the extension 70 and the support element 72 receive a length of needle tubing 74, preferably 17 gauge. Disposed within the tubing 74 are a pair of polyethylene tubes 76, 78, the smaller tube 76 being telescoped within the other tube 78, the two tubes binding against each other. The larger diameter polyethylene tube is provided with a flared or bell shaped end 78.1 which may receive a disposable pipette tip. Thus, the flared end 78.1 is a female tip receiver which snugly receives the male disposable tip 14.

A piston, in the form of a stainless steel wire 80, is carried at one end by the plunger 58. The other end of the wire 80 is closely received by the polyethylene tube 76 for sliding movement therein. Thus, the tube 76 acts as a cylinder and the wire 80 acts as a piston within the cylinder 76.

The manner of operation of this device is similar to that of the design shown in FIGS. 1-4. Thus, a suitable length of Teflon® tubing is cut off from a supply roll, and one end of the tubing 14 is snugly inserted into the bell-shaped outer end 78.1 of the tube 78 until it abuts against the inner tube 76 in the manner illustrated, the Teflon® tubing being frictionally or snugly held in place by the tubing 78. The plunger 58 will now be moved in the direction of arrow 64 until the button 66 contacts the guide 68. The tip 14 will now be placed in the liquid sample. The button end 66 of the plunger is now released, permitting the spring 62 to withdraw the plunger. As the diameter of the disposable tips are quite consistent, and as the stroke of the piston from fully extended position to the fully released position is always the same, very accurate small volumes in the range of 0.1 $\mu$l to 2.0 $\mu$l may be withdrawn.

While the best modes of this invention known to applicant at this time have been shown in the accompanying drawings and described in the accompanying text, it should be understood that applicant does not intend to be limited to the particular details illustrated in the accompanying drawings and described above. Thus, it is the desire of the inventor of the present invention that it be clearly understood that the embodiments of the invention, while preferred, can be readily changed and altered by one skilled in the art and that these embodiments are not to be limiting or constraining on the form or benefits of the invention.

What is claimed is:

1. A pipette assembly having a small volume disposable tip capable of taking very small quantities of samples in an accurate manner, the pipette assembly being of an inexpensive construction, the pipette assembly comprising:

a suction device having a female receiver of a flared or bell shape for receiving disposable pipette tips; and a disposable pipette tip formed of extruded plastic tubing which has relatively uniform inside and outside diameters throughout its length, the tubing being snugly received in the flared or bell shaped female receiver of the suction device.

2. The pipette assembly as set forth in claim 1 wherein the extruded plastic material is formed of a hydrophobic material.

3. The pipette assembly as set forth in claim 2 wherein the hydrophobic material is Teflon®.

4. A pipette assembly having a small volume disposable tip capable of taking very small quantities of samples in an accurate manner, the pipette assembly being of an inexpensive construction, the pipette assembly comprising:

a suction device having a piston cylinder in the form of a narrow tube having a distal end, a piston slidable within the piston cylinder, the piston being in the form of a thin wire having a distal end, means to move the piston between extended and retracted positions, the distal end of the piston being adjacent the distal end of the piston cylinder when in the extended position whereby there is substantially no air within the piston cylinder when the piston is extended, and a female receiver of a flared or bell shape for receiving disposable pipette tips, the female receiver being carried adjacent the distal end or the piston cylinder; and a disposable pipette tip formed of extruded plastic tubing which has relatively uniform inside and outside diameters throughout its length, the tubing being snugly received in the female receiver of the suction device, with one end adjacent the piston cylinder.

5. A method of drawing up precise quantities of liquid samples in the range of 0.2 to 2.0 $\mu$l, said method comprising the following steps:

providing a cylinder of plastic material which has a uniform inside diameter of about 0.2 to 0.3 mm., the cylinder having a flared or bell shaped distal end;

providing a disposable pipette tip consisting of extruded tubing of teflon® or other hydrophobic material, the tubing having relatively uniform inside and outside diameters throughout its length, the inside portion of the tubing having a volume of about 0.2 to 2.0 $\mu$l, the tubing having first and second ends;

connecting the first end of the tubing with the distal end of the cylinder by introducing the first end of the tubing into the flared or bell shaped distal end to achieve a tight fit;

providing a piston slidable within the cylinder, the piston being in the form of a thin wire;

inserting the second end of the tubing into a liquid sample; and moving the wire piston away from the sample about a 5–20 mm. stroke to produce a sample having a volume from 0.2 to 2.0 $\mu$l.

6. An apparatus of delivering precise quantities of liquid samples in the range of 0.2 to 2.0 $\mu$l, said apparatus comprising the following:

a cylinder of plastic material which has a uniform inside diameter of about 0.2 to 0.3 mm., the cylinder having a flared or bell shaped distal end;

a disposable pipette tip consisting of extruded tubing of teflon® or other hydrophobic material, the tubing having relatively uniform inside and outside diameters throughout its length, the inside portion of the tubing having a volume of about 0.2 to 2.0 $\mu$l, the tubing having first and second ends; the first end of the tubing being connected with the funnel shaped distal end of the cylinder;

a piston slidable within the cylinder, the piston being in the form of a thin wire;

means for inserting the second end of the tubing into a liquid sample; and means for moving the wire piston away from the sample about a 5–20 mm. stroke to produce a sample having a volume of from 0.2 to 2.0 $\mu$l.

* * * * *